United States Patent [19]

Ovard

[11] 3,998,394

[45] Dec. 21, 1976

[54] WATER FLOW CONTROL VALVE AND DIFFUSER FOR CROSSFLOW COOLING TOWERS

[75] Inventor: John C. Ovard, Columbia, Md.

[73] Assignee: Baltimore Aircoil Company, Inc., Jessup, Md.

[22] Filed: July 1, 1975

[21] Appl. No.: 592,307

[52] U.S. Cl. ..... 239/562; 137/625.48; 261/66; 261/DIG. 11

[51] Int. Cl.[2] ..... A62C 37/20

[58] Field of Search ..... 261/110, 111, 98, 19, 261/66, 71, DIG. 11; 239/553.3, 562, 565, 582; 251/118, 325; 137/625.38, 625.48

[56] References Cited

UNITED STATES PATENTS

| | | | |
|---|---|---|---|
| 1,013,242 | 1/1912 | Valloppi | 251/325 X |
| 1,275,854 | 8/1918 | Cooley | 251/325 |
| 2,886,126 | 5/1959 | De Flon | 261/110 X |
| 3,008,652 | 11/1961 | McLean | 239/582 X |
| 3,268,217 | 8/1966 | Goitein | 261/DIG. 11 X |
| 3,875,269 | 4/1975 | Forchini et al. | 261/111 |

*Primary Examiner*—Frank W. Lutter
*Assistant Examiner*—William Cuchlinski, Jr.
*Attorney, Agent, or Firm*—Michael C. Sudol, Jr.

[57] ABSTRACT

A crossflow cooling tower, water flow control valve and diffuser which includes an open ended inner valve cylinder which moves from a closed to an open position by means of a screw mechanism and allows water to be evenly distributed over a 360° range to all parts of a hot water basin located directly under the valve. The water leaving the valve is directed and proportioned by a series of baffles and a cone to effect a uniform distribution over the basin.

3 Claims, 7 Drawing Figures

43
40
41
42
44
55
102
50
51
80
56
49
47
48
72
84
54
52
46
45
53
4
4

WATER FLOW CONTROL VALVE AND DIFFUSER FOR CROSSFLOW COOLING TOWERS

BACKGROUND AND SUMMARY OF THE INVENTION

This invention relates to a water flow control valve and diffuser for flow proportioning and for distributing water from a point source to a water basin in a single integral valve and diffuser unit.

Among the problems associated with prior water valve designs and distribution system arrangements for cooling towers is that uniform water distribution to the fill assembly area is seldom achieved in practice. In practice, generally one flow control valve is used in each hot water basin with the valve being located near the center of the basin. The water leaving the valve enters a diffusion box which is normally below the valve discharge. The purpose of this diffusion box is to decrease the water velocity and to redirect flow radially outward in the hot water basin. In the prior art, no positive means was provided in the diffuser box or valve design to proportion and direct the flow for uniform distribution from a point source to a rectangular water basin. Consequently, localized eddies, high velocity crosscurrents and wave action typically occurs within the basin resulting in poor water distribution. Prior valve and diffuser box arrangements also have relatively high hydraulic friction losses thereby requiring more pumping energy than desired.

Furthermore in U.S. Pat. No. 3,875,269 issued on Apr. 1, 1975, to Ecodyne Corp., there is described a cooling tower distribution box. This box, however, differs from applicant's in that the water is not positively proportioned and redirected and does not flow out smoothly from the distribution box. Also, in the valve in U.S. Pat. No. 3,875,269 water is directed against an upper shroud wherein the water is then forced or directed down into a distributing box where ribs and baffles direct the water outward to the pan section. There is much friction loss and inconvenience and small flows of water are not equally distributed since the water first hits the covering shroud to dissipate flow energy before it is directed to the distributing means.

In applicant's case, as the cylinder portion of the valve is lifted off its seat even a small amount of water will flow smoothly through the equalizing baffles and be distributed to the pan section.

Also, the typical conventional distribution boxes used in the prior art have included a honeycomb type wood structure to receive the splashing water and distribute it under its outer edges across the hot water basin. These boxes have tended to be very large and have many parts which are time consuming to erect. A large pressure drop also is present across these boxes which causes pumping and distribution problems. Being constructed of wood these boxes do not offer good resistance to corrosion and, therefore, require frequent maintenance.

The primary object of this invention is to provide a water flow control valve and diffuser for a crossflow cooling tower which provides a positive means for controlling, directing, proportioning and diffusing water from a point source to a rectangular hot water basin with the flow control function and the proportioning and redistribution functions all accomplished in a single, integral unit.

A further object of this invention is to reduce the hydraulic friction losses and internal forces acting on the working parts of the valve.

A still further objective is to provide a valve which contains means for a positive shut off of water flow.

A still further object is to provide a crossflow cooling tower water flow control valve and diffuser which is constructed mainly from plastic parts and thereby offers resistance to corrosion and which is simple and economical to construct.

Other objects of this invention will be readily appreciated as the same becomes better understood by reference to the following detailed description when considered in connection with the accompanying drawings.

Wherein.

Figure 1:
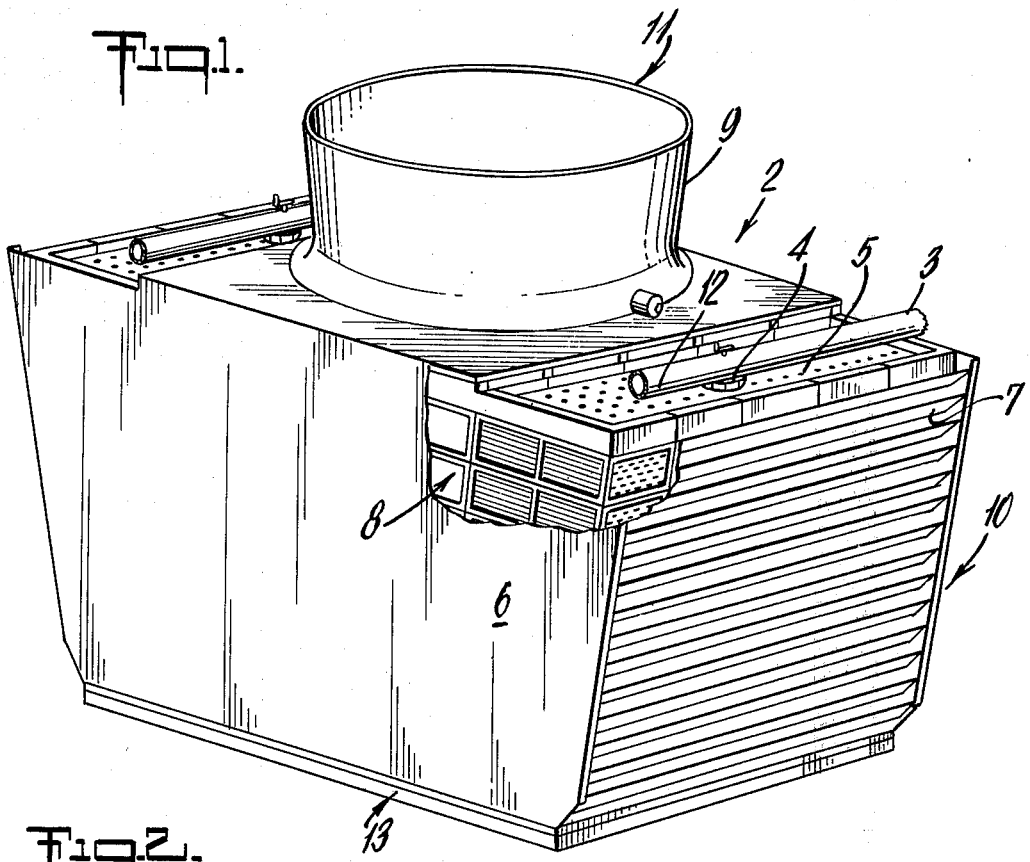
FIG. 1 is an isometric view of a typical crossflow cooling tower which incorporates the water flow control valve and diffuser.

Referring now to FIG. 1, there is shown a typical crossflow cooling tower wherein the water flow control valve and diffuser of the instant invention is shown generally as 4. This cooling tower has two sides enclosed and two sides open. Air enters at 10 on each side, flows through the fill section shown generally as 6, passes through mist eliminators shown generally as 8 and out through the exit portion 11. Air flow is caused in this crossflow cooling tower by a fan not shown mounted generally in cowl 9. Louvers 7 are incorporated in the air intake sides to prevent water splashout from the fill assembly area.

The structure shows a hot water basin 5 at the top which is located directly under and which receives water from the water control valve and diffuser 4 which itself receives the water from the heat source (not shown) through horizontal manifold pipe 3. Throughout the hot water basin 5 are located holes or nozzles or other means 12 for directing or spraying the hot water down on the fill section 6. In this fill section some of the water evaporates allowing the bulk of the water to be cooled. The cooled water is collected in water collecting basin or sump 13 whereafter it is reused.

Figure 2:
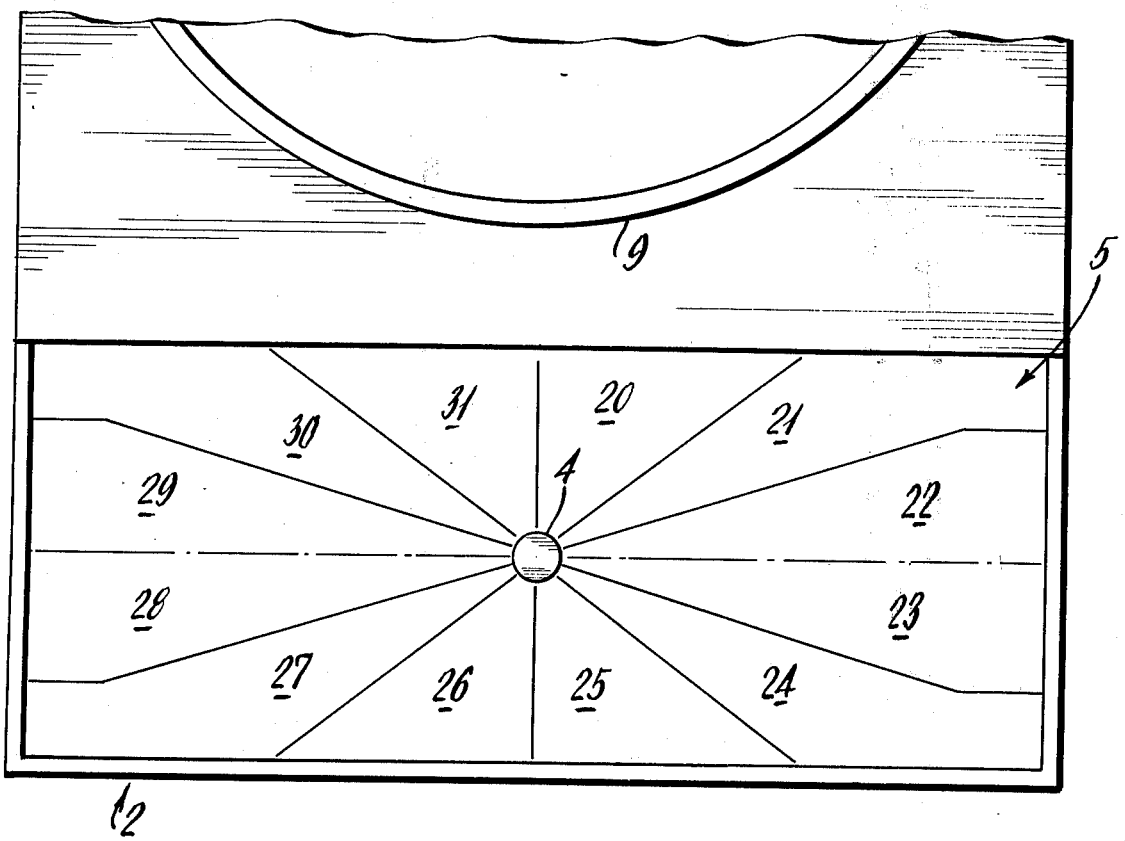
FIG. 2 is a top view of a typical water distribution pan having imaginary lines to show equal water distribution areas to which proportional flows are provided by the water flow control valve and diffuser.

The hot water distributing pan section is shown in greater detail in FIG. 2. Imaginary lines emanating from the water distribution valve 4 divide the hot water distributing pan into equal sections in area for uniform flow. Each area 20–31 so denoted must receive an equal volume of water. The hot water distributing pan has sides 32 which confine the water to the pan itself. As a result of the appropriate placing of vanes shown as 71–82 in FIG. 5 in the bottom section of the water distributing valve and diffuser, flow is proportioned so that each general area shown as 20–31 in FIG. 2 of the hot water distributing pan will receive an approximately equal amount of water. Thus, no area of the hot water distributing pan is starved from water and it can be seen that an even distribution of the hot water over the distributing pan allows for a substantially steady, constant and equal flow of water downward in each part of the fill area in FIG. 1. This results in greater efficiency of the cooling tower since no area of the fill section is starved and/or flooded with water.

Figure 3:
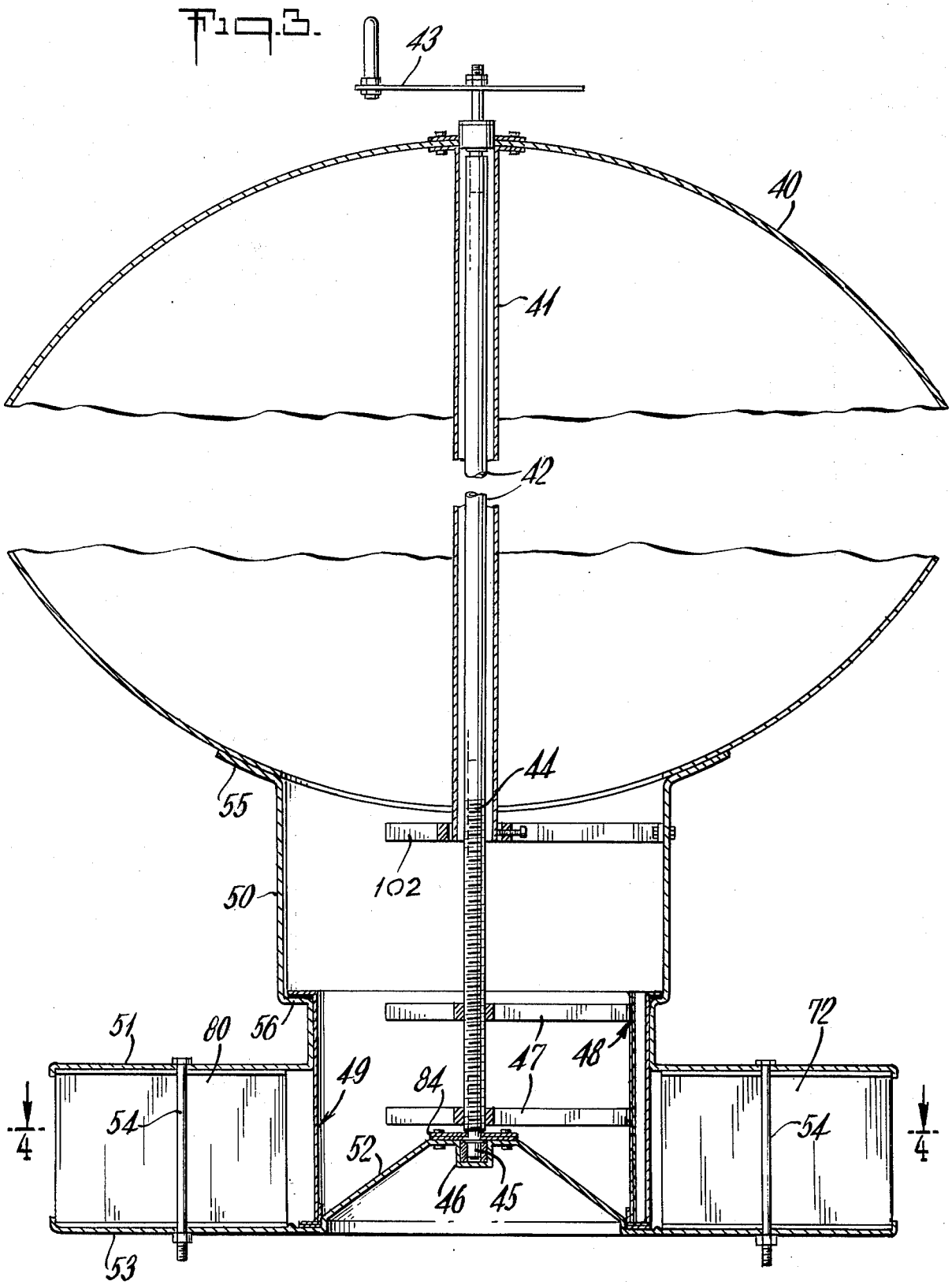
FIG. 3 is a sectional view of applicant's water flow control valve and diffuser showing said valve attached to a typical manifold.

FIG. 3 shows a cross section area of the water distribution valve and diffuser of applicant's invention. Typically an upper valve body shown as 50 is attached at 55 to a horizontal manifold pipe 40. The manifold pipe 40 is shown in FIG. 3 as fragmented. An inner valve cylinder 49 open at both ends is adapted to slide concentrically into the upper portion of the upper valve body 50. A power screw housing 41 is fixedly attached to the top portion of manifold pipe 40 and goes through the manifold pipe vertically or at a 180° angle to exit the manifold pipe at the bottom thereof. Within the power screw housing 41 and extended below it, is a power screw itself 42 being threaded 44 at the lower end.

The extreme lower end 45 of the power screw 42 is rotatably attached to the lower valve body 53 at a cone shaped inner portion of said lower valve body 52. The entire lower valve body 53 is generally circular shaped with an inner concentric circular base in the shape of a cone shown as 52. This lower valve body is placed a finite distance from an extension 51 of the upper valve body 50. This distance represents the total opening for water flow when valve cylinder 49 is in a completely open position. The power screw 42 at its lower end 45 is attached to the lower valve body 53 but is so attached that it can rotate. This can be done by allowing the enlarged lower end of power screw 45 to rotate in a cavity 46 in lower valve body 53. A cover plate 84 attached to the lower valve body prevents the power screw 42 from being removed from the cavity during operation. Incorporated to move on the threaded portion 44 of the power screw 42 are a plurality of cylindrical linkages 47 which are fixedly attached at their outer end 48 to the open ended inner valve cylinder 49. A stationary linkage 102 can be fixedly attached to the lower end of the power screw housing 44 and upper valve body 50 to provide additional alignment and support for the power screw 42.

In operation when said power screw is turned such as by crank handle 43, the cylinder linkages 47 move up or down the threaded portion of power screw 42 and as such move inner valve cylinder 49 vertically upward or downward. The valve is shown in an entirely closed position in FIG. 3 wherein the lower edge of inner valve cylinder 49 rests snugly against the lower valve body 53 and cone section 52. The area where said inner valve cylinder rests against the lower valve body must be sealed such as by a water gasket 91 to ensure a tight seal when said valve is closed. Also to insure a watertight fit, the upper section of inner valve cylinder 49 is flanged and when said valve is closed this upper flange rests against a horizontal indented portion 56 of upper valve body 50. A watertight seal must also be provided at 56 and this is done in a conventional manner using water gaskets, etc.

Figure 6:
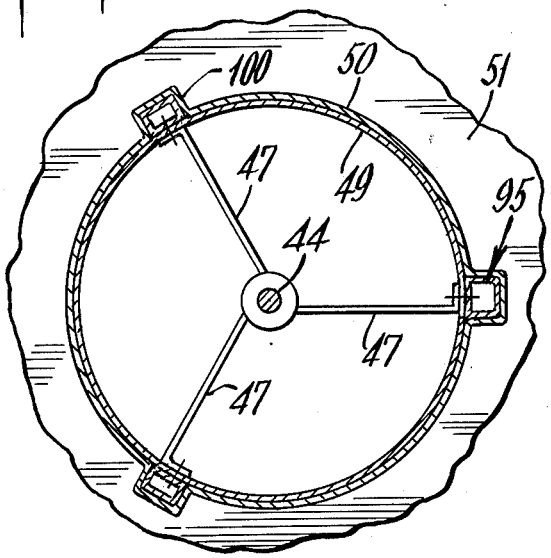
FIG. 6 is a section view taken along line 6—6 of FIG. 5 which shows the open ended inner valve cylinder and guide vanes attached thereto.

As shown in FIG. 6 cylinder guide vanes 95 are fixedly attached to the inner valve cylinder and move slidably and vertically in vane slots 100 on upper valve housing 50 to prevent rotation or misalignment of inner valve cylinder 49 when said cylinder is slidably moved upward or downward. Generally as can be seen from FIG. 6, there are provided as a minimum three cylinder linkages 47 at each part of the threaded portion of power screw 42.

Figure 5:
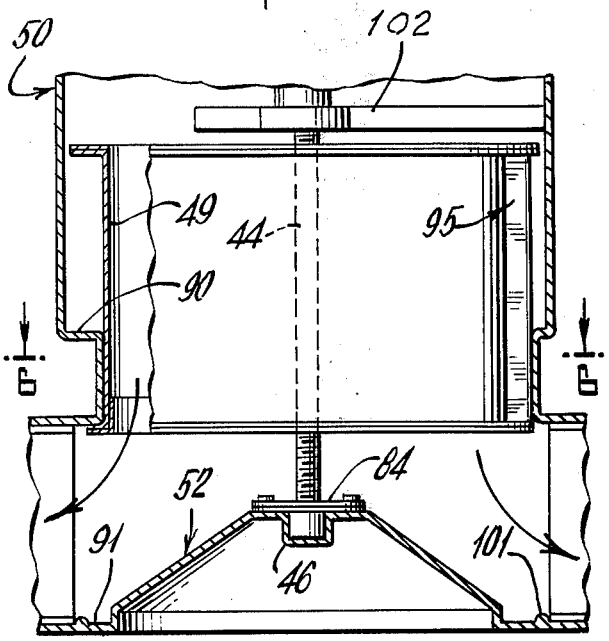
FIG. 5 is a detailed sectional view of a water flow control valve and diffuser of applicant's invention showing said valve in the completely open position and the path of water flow therethrough.

FIG. 5 shows the water flow control valve in a completely open position. Thus, liquid from the manifold pipe flows down through the upper valve body and through the inner area of inner valve cylinder 49. The liquid is then redirected radially outward by the cone 52 and flows equally in all directions outward along the inner surface of lower valve body 53 to the hot water basin 5 upon which the valve lies or rests. Thus, even when inner valve cylinder 49 is slidably moved upward a small distance, water will still flow out equally in a radial pattern over cone 52 and out along the inner surface of lower valve body 53.

Figure 4:
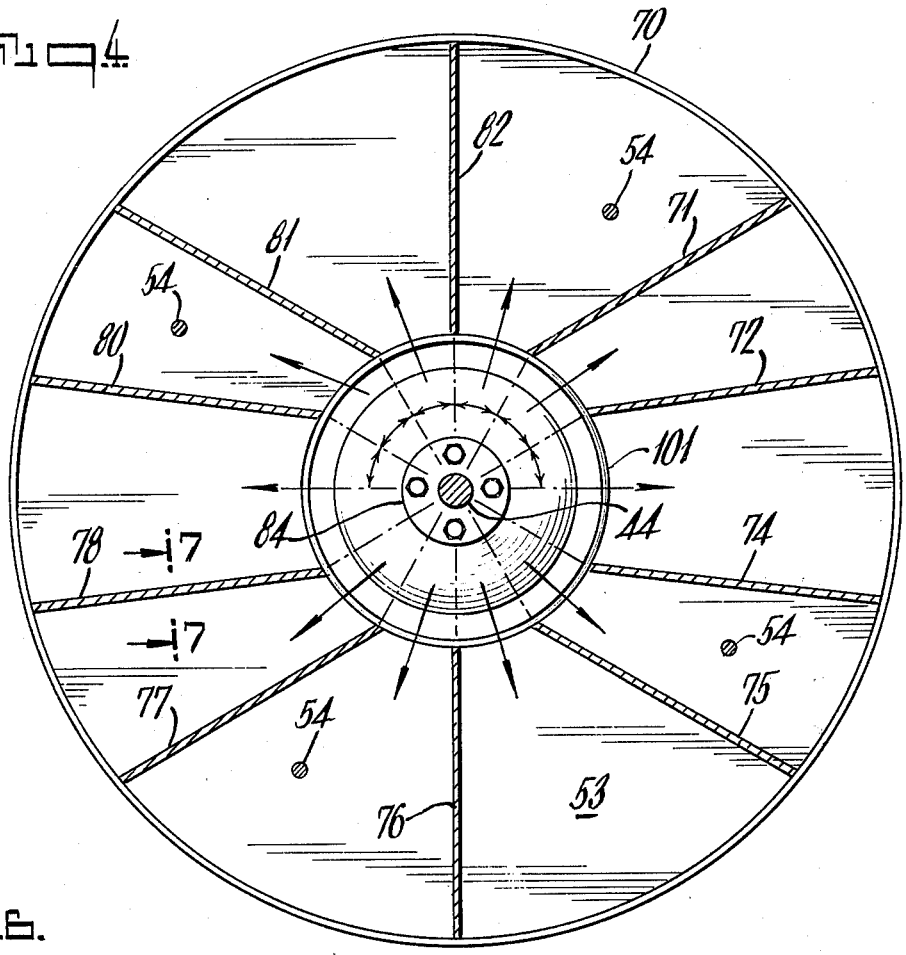
FIG. 4 is a sectional view taken along line 4—4 of FIG. 3 which shows the flow proportioning and directing vanes of the diffuser section.

Provided along the surface of lower valve body 53 are flow directing baffles or vanes 71, 72, 74, 75, 76, 77, 78, 80, 81, and 82 (71–82) as shown in FIG. 4. These vanes are equally spaced from each other along the circumference of a circle 101 which has a diameter slightly larger than the diameter of the circular valve seal 91 thereby splitting the flow proportionately. This circle can be a raised projection 101 which provides a boundary for the vanes. Thus the arc distance along said concentric circle between vanes 82 and 71 is the same as that between 75 and 76, 77 and 78, 81 and 82, etc. The arc distance between vanes 72 and 74 is twice that as between vanes 71 and 82 since it serves twice the area, i.e. area 22 and 23 in FIG. 2 as opposed to area 21 between 71 and 72. Also, these vanes lead from the inner area of the lower valve seat emanating from a circle formed by the inner valve cylinder 49 outward to the outer edge of the lower valve body 53.

The baffles or vanes 71–82 are fitted in grooves made in the lower valve seat 53. Thus grooves are formed by projections on the lower valve body and are shown as 98 and 99 in FIG. 7. These flow directing vanes or baffles 71–82 redirect the water emanating from the opening of inner valve cylinder 49 to equally distribute and redirect the flow equally to all areas of the hot water distributing pan. The lower valve body 53 rests or lies directly on top of the hot water distribution basin 5.

It will be appreciated by those skilled in the art that although the arc distance between each vane, for example 71 and 72, along the circumference of circle 101 are equal as shown in FIG. 4, the arc distance between each set of vanes 71–82 at the circumference of the circle 70 formed by outer dimension of the lower valve body 53 will vary depending on the shape of the hot water distribution basin to be served. Thus for a rectangular hot water distribution basin 5 shown in FIG. 2 the arc distance along the circumference of outer circle 70 of lower valve body 53 between vanes 82 and 71 for example is larger than the arc distance along the circumference of outer circle 70 between vanes 71 and 72 since the length of the rectangular hot water basin is about twice as great as its width and the distance from the valve 4 to the length dimension is much shorter than the distance from the valve 4 to the width dimension of the hot water basin. In either case, however, the area 20 of the hot water basin 5 served by water emanating from the opening between vanes 71 and 82 is approximately equal to the area 21 of the hot water basin 5 served by water emanating from the opening between vanes 71 and 72.

The arc distances between the vanes along the circle 101 are shown in FIG. 4 as being equal, however, one will realize that they can be unequal or varied. If so, the larger the arc distance between vanes along circle 101 the larger the area of the hot water basin 5 that those adjacent vanes would direct to.

Figure 7:
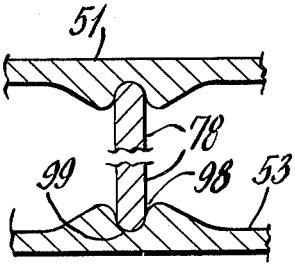
FIG. 7 is a sectional view taken along line 7—7 of FIG. 4 and shows the flow proportioning and directing vanes and the method of support provided by the upper valve housing diffuser cover (Item No. 51) and the lower diffuser cover of the lower valve housing.

In a preferred embodiment of this invention there is shown an upper cover 51 which can be part of the upper valve body 50. This cover 51 lies generally parallel with lower valve body 53 and forms with lower valve body 53 an opening of 360° around the inner valve cylinder 49. The purpose of cover 51 is to provide additional support for vane 71–82 as can be seen in FIG. 7 wherein the upper portion of vane 78 is imbedded in a grooved portion of the cover 51 in a similar manner as the lower portion of the valve is attached to the lower valve body. Also, additional support and stability can be given the vanes by bolts 54 spaced periodically around the upper cover 51 which bolts hold the upper cover 51 and the lower valve body 53 tightly together.

In operation of the water control valve and diffuser, water from manifold 40 FIG. 3 drops through the upper housing 50 and out through the inner valve cylinder 49 when said inner valve cylinder is in an open position as depicted in FIG. 5. The water flowing downwardly is redirected by the cone 52 of the lower valve body 53 radially outwardly and is smoothly and equally proportioned and directed into the hot water basin 5 upon which the lower valve body 53 rests by flowing smoothly along the lower valve body 53.

It should be understood of course that the foregoing disclosure relates to a preferred embodiment of the invention and numerous modifications or alterations may be made by those skilled in the art without departing from the spirit and scope of the invention as set forth in the appended claims.

What is claimed is:

1. A water distribution valve for uniformly and equally distributing water over a substantially horizontal water basin having water distributing means positioned therethrough, said water being received from a substantially horizontal manifold pipe which comprises:

a. an inner valve cylinder open at both ends;

b. an upper valve body for concentrically receiving said inner valve cylinder;

c. drive means capable of slidably moving said inner valve cylinder in said upper valve body from a closed to an open position and vice versa;

d. a lower valve body located below the upper valve body and forming with the upper valve body a 360° opening for water to flow therethrough when said inner valve cylinder is in an open position, said lower valve body having a water directing central portion and said lower valve body having said inner valve cylinder abut thereon when said valve is in a closed position;

e. a series of narrow baffles located on the inner surface of the lower valve body extending from said water directing central portion of lower valve body outward along the inner surface of said lower valve body and being disposed at arc distances from each other, said arcs being part of the circumference of the circle whose diameter is slightly larger than the diameter of the inner valve cylinder;

f. the lower valve body contains grooves for receiving said baffles.

2. The valve of claim 1 which comprises an additional vertical extension of said upper valve body which extension lies in a plane essentially parallel to the plane of said lower valve body, said vertical extension providing additional lateral support for the baffles.

3. The valve of claim 1 which comprises additionally guide means along the lower portion of said upper valve body and along the inner valve cylinder to prevent rotation of the inner valve cylinder.

* * * * *